US012453897B2

(12) United States Patent
McWilliams et al.

(10) Patent No.: US 12,453,897 B2
(45) Date of Patent: Oct. 28, 2025

(54) SYSTEM, APPARATUS, AND METHOD FOR MONITORING ATHLETIC OR EXERCISE PERFORMANCE

(71) Applicant: SoulCycle Inc., New York, NY (US)

(72) Inventors: Derek McWilliams, New York, NY (US); Jeremy Landis, New York, NY (US); Bren Cavallo, New York, NY (US); Dallas Simpson, New York, NY (US); Christopher Blaich, New York, NY (US)

(73) Assignee: SoulCycle Inc., New York, NY (US)

( * ) Notice: Subject to any disclaimer, the term of this patent is extended or adjusted under 35 U.S.C. 154(b) by 0 days.

(21) Appl. No.: 18/106,142

(22) Filed: Feb. 6, 2023

(65) Prior Publication Data

US 2023/0330486 A1 Oct. 19, 2023

Related U.S. Application Data

(63) Continuation of application No. 16/924,913, filed on Jul. 9, 2020, now Pat. No. 11,596,834.
(Continued)

(51) Int. Cl.
*A63B 22/06* (2006.01)
*A63B 24/00* (2006.01)
*A63B 71/06* (2006.01)

(52) U.S. Cl.
CPC ..... *A63B 24/0062* (2013.01); *A63B 71/0622* (2013.01); *A63B 2024/0068* (2013.01); *A63B 2071/0625* (2013.01); *A63B 2225/50* (2013.01)

(58) Field of Classification Search
CPC ..... A63B 24/0062; A63B 24/0068; A63B 71/0622
See application file for complete search history.

(56) References Cited

U.S. PATENT DOCUMENTS 6,287,239 B1 * 9/2001 Hernandez ..... A63B 21/012 482/902
7,537,546 B2 * 5/2009 Watterson ..... A63B 71/0622 482/8

(Continued)

FOREIGN PATENT DOCUMENTS

DE 19955720 C2 * 4/2002 ..... A63B 24/00
WO WO-2008030484 A2 * 3/2008 ..... A61B 5/0022

*Primary Examiner* — Alvin A Hunter
(74) *Attorney, Agent, or Firm* — Fitch, Even, Tabin & Flannery LLP

(57) ABSTRACT

In some embodiments, apparatuses and methods are provided herein useful to monitor athletic performance. In some embodiments, one or more control circuits and sensors are used to analyze performance as it compares to music tempo that is played during an exercise session or class, which may be done both directly and/or indirectly. In one embodiment, athletic performance during an exercise period is monitored and compared to the tempos of music played, where the music tempo is identified by one of measuring the actual tempo of the music played and/or obtaining the tempo from a database or otherwise associating the selection(s) played with an identified tempo of the music itself. In another embodiment, the music tempo is indirectly identified or analyzed, such as by analyzing the performance or cadence of a group of exercisers and comparing the performance parameters sensed to obtain a benchmark tempo from which to compare individual users.

14 Claims, 9 Drawing Sheets

Related U.S. Application Data

(60) Provisional application No. 62/872,537, filed on Jul. 10, 2019.

(56) References Cited

U.S. PATENT DOCUMENTS 7,542,816 B2 6/2009 Rosenberg
7,728,214 B2 6/2010 Oliver et al.
8,101,843 B2 1/2012 Turner
8,369,537 B2 * 2/2013 Bieber ..... G10H 1/0008 381/98
8,529,407 B2 * 9/2013 Nurmela ..... A63B 24/0062 482/8
8,608,621 B2 12/2013 Ogg et al.
8,645,373 B2 2/2014 Knight et al.
8,727,947 B2 5/2014 Tagliabue
8,808,144 B2 8/2014 Ogg et al.
8,996,332 B2 * 3/2015 Kahn ..... A61B 5/1123 702/141
9,079,060 B2 * 7/2015 Hong ..... A61B 5/7455
9,174,085 B2 * 11/2015 Foley ..... G16Z 99/00
9,183,822 B2 11/2015 Macpherson
9,449,084 B2 9/2016 Chong et al.
9,536,560 B2 1/2017 Jehan et al.
9,568,994 B2 * 2/2017 Jehan ..... G06F 16/636
9,675,866 B2 * 6/2017 Sako ..... A63B 24/00
9,767,777 B1 9/2017 Macpherson
10,421,002 B2 * 9/2019 Smith ..... G10H 1/42
10,478,708 B2 * 11/2019 Bleich ..... A63B 24/0075
10,674,958 B2 * 6/2020 Bleich ..... A61B 5/021
11,291,886 B2 * 4/2022 Hansen ..... G16H 20/30
11,596,834 B2 3/2023 McWilliams
2009/0227429 A1 * 9/2009 Baudhuin ..... A63B 22/0605 482/57
2016/0342199 A1 * 11/2016 Smith ..... A61B 5/4266
2016/0342201 A1 * 11/2016 Jehan ..... A63B 71/00
2016/0342686 A1 * 11/2016 Garmark ..... G06F 16/686
2016/0342687 A1 * 11/2016 Garmark ..... G06F 16/683
2016/0343363 A1 * 11/2016 Garmark ..... G10H 1/42
2016/0343399 A1 * 11/2016 Jehan ..... A61B 5/1118
2016/0343410 A1 * 11/2016 Smith ..... G11B 27/28
2017/0235540 A1 8/2017 Jehan
2018/0005615 A1 1/2018 Macpherson
2021/0008412 A1 1/2021 McWilliams

* cited by examiner

SYSTEM, APPARATUS, AND METHOD FOR MONITORING ATHLETIC OR EXERCISE PERFORMANCE

CROSS-REFERENCE TO RELATED APPLICATIONS

This application is a continuation of U.S. patent application Ser. No. 16/924,913, filed Jul. 9, 2020, issued as U.S. Pat. No. 11,596,834 on Mar. 7, 2023, which claims the benefit of U.S. Provisional Application No. 62/872,537, filed Jul. 10, 2019. The entire contents of these applications are incorporated by reference herein.

TECHNICAL FIELD

The present disclosures relates generally to the field of fitness, and more specifically, monitoring athletic or exercise performance.

BACKGROUND

Many individuals find it desirable to listen to music while exercising or performing other fitness-related activities. Such exposure to music may positively impact athletic performance, such as, for example, by improving performance output and/or duration of a workout. For example, songs having a higher tempo may encourage the individual to work harder while exercising. Music also may improve an exercise experience, which may encourage participants to increase the frequency of their exercise endeavors.

While it is known to provide music during exercise classes, individuals respond differently to music exposure, in part, as a result of fitness levels, overall health, and music preferences, among other factors. Indeed, like many personal preferences people may respond to some songs differently, and given the impact of music exposure on performance, it would be beneficial for individuals to understand what type of music positively impacts their individual performance, and to what extent.

BRIEF DESCRIPTION OF THE DRAWINGS

Disclosed herein are embodiments of systems, apparatuses, and methods pertaining to monitoring athletic or exercise performance. This description includes drawings, wherein.

Figure 1:
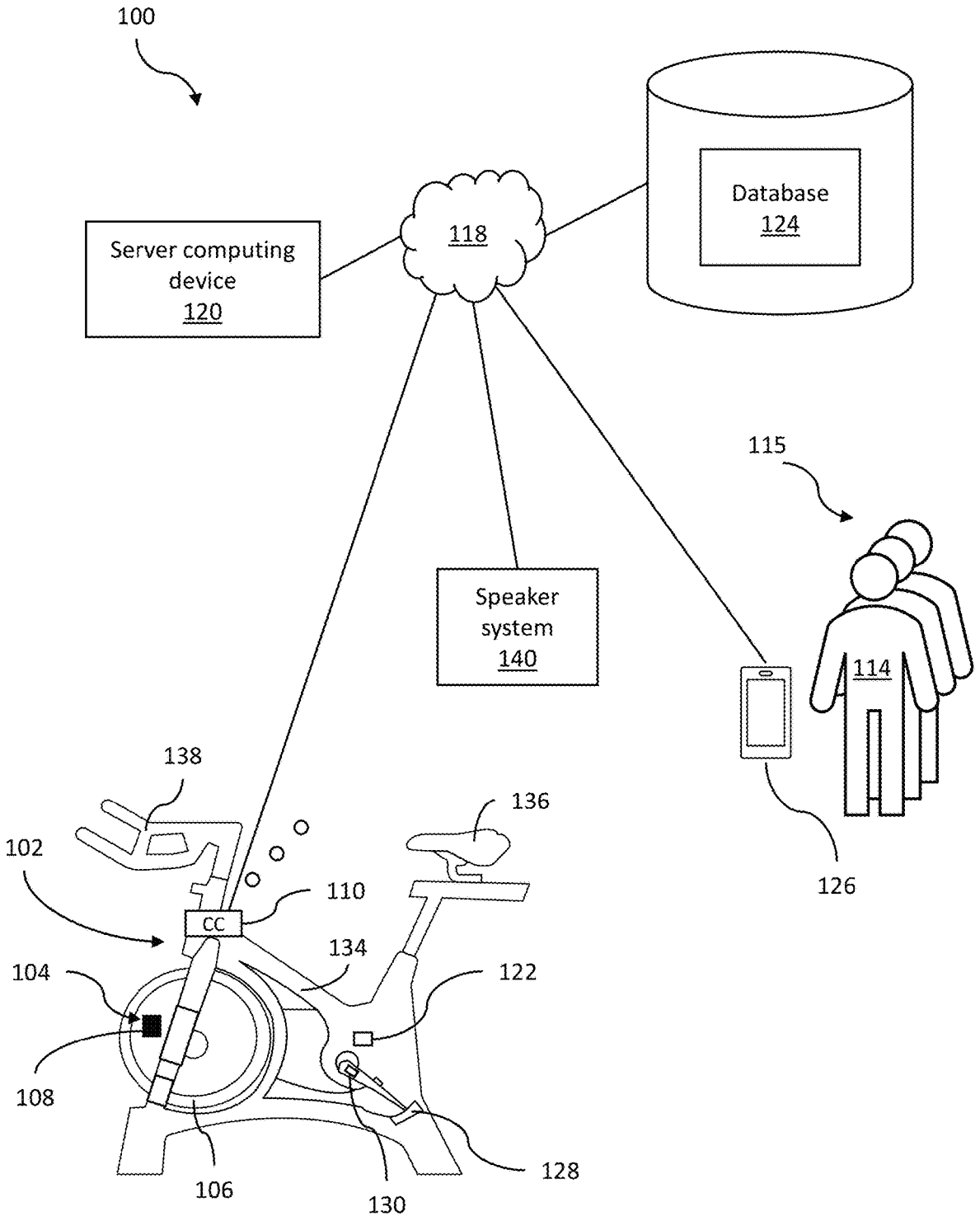
FIG. 1 is a schematic diagram of an example system for evaluating performance of a particular user, the system having a plurality of network-connected exercise bikes each associated with a user, in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to the present disclosure, systems, apparatuses and methods are provided herein to monitor or evaluate athletic performance. In some configurations, the evaluation may be useful for helping users identify music to improve athletic performance. Indeed, by understanding or identifying particular music that motivates an individual during an exercise class or session, the user can select music that improves the user's athletic performance. The terms "music" and "selection" herein refer generally to any audible output of a speaker, headphone, musical instrument or other device. A selection may be a song or other musical piece, or other audible output.

In some embodiments, example methods provided herein can be used to provide users with a summary of their performance compared to one or more tempos of the selections played during an exercise class or session. By one approach, a user can be given a display of performance metrics, such as, an on-beat match, average revolutions-per-minute (RPM), distance, power generated, and/or heartrate, among many other options. Further, receiving such feedback can be motivational for users such that participants strive to improve their reported performance metrics.

In some embodiments, an example system for monitoring athletic performance as it compares to, for example, music played, includes one or more control circuits and sensors that are used to analyze performance of users as it compares to a tempo of the music played during an exercise session or class. Specifically, the sensors may be configured to detect one or more performance parameters of a group of users or exercisers. Such a comparison may be done directly and/or indirectly. In one embodiment, athletic performance at an exercise station is monitored and compared to the tempo of the music played, where the music tempo is identified by one or more of measuring the actual tempo of the music played, obtaining the tempo from a database, or otherwise associating the selection(s) played with an identified tempo of the music itself. In such a configuration, which compares a particular user or exerciser's cadence with a beat or tempo of a selection, the system may also compare the particular user's performance with other users or exercisers to provide the user a sense of their relative performance compared to, for example, an exercise class. Further, in some embodiments, a music tempo of a song played during an exercise period may be indirectly inferred, identified or analyzed, such as by analyzing the performance or cadence of a group of exercisers and comparing the performance parameters or indicators sensed to obtain a benchmark tempo or target cadence from which to compare individual users to the group. In such a configuration, a music tempo is inferred from the performance of other exercisers, as opposed to being directly measured or otherwise ascertained from the selection(s) played to the group.

By one approach, the sensor may include a power meter, an optical sensor, and/or a magnetic flywheel sensor, among other options. In some embodiments, sensor(s) are configured to measure, for example, a pedal cadence of a user, a rotational speed of a flywheel, a power output, and/or leg movements of a user. Sensors may be manufactured with and integrated with the exercise equipment or may be manufactured separately. In some embodiments, a sensor is configured to be detachably coupled to exercise equipment at an exercise station, such as the stationary bike. In other forms, the sensor may include a biometric sensor, as described in further detail below.

In some embodiments, such as one that employs a direct beat match (i.e., matching the user's measured performance parameter to the tempo of a selection), the system for measuring performance of a user or exerciser, such as one using a stationary bike, can include a sensor configured to measure at least one performance parameter of a user associated with the stationary bike, an electronic user device, and a control circuit. Alternatively, the system for measuring performance may include other exercise equipment such as a rowing machine, an elliptical machine, and/or a treadmill, among many others. By one approach, the control circuit, which is in communication with the sensor and the electronic user device, is configured to determine at least one performance metric (such as an on-beat match) based on a comparison between the performance parameter measured by the sensor and a target parameter calculated based on one or more tempos of one or more selections played during an exercise period. Once the performance metric is ascertained for a particular user, it may then be sent to an electronic user device associated with the particular user.

In operation, an example method may be used to evaluate performance of a user or exerciser by detecting, via a sensor operatively coupled to the exercise equipment, such as the stationary bike, a performance parameter of the user while a selection is being played. The method may also include comparing, via a processor communicatively coupled to the sensor, a tempo of the selection and the detected performance parameter of the user, and determining, via the processor, a match score based at least in part on the comparison between the tempo of the selection and the detected performance parameter. The method also typically includes playing one or more selections during an exercise period, each of the one or more selections including one or more tempos, and may include recommending one or more selections to the user based at least in part on the match score determined by the processor. By one approach, the recommendation may include sending a communication signal to an electronic user device or mobile device of the user that displays a recommendation for the user and/or a summary of the athletic performance.

As noted above, the teachings here also accommodate monitoring athletic performance by indirectly inferring the music tempo by comparing a set of exercisers or users. In such a configuration, a system for evaluating performance of a user during an exercise period may include a plurality of exercise stations (e.g., a plurality of stationary bikes), at least one sensor operatively coupled to each of the exercise stations (where the sensors measure at least one performance parameter associated with a particular user of an exercise station), and communication circuitry operatively coupled to the sensors such that they can communicate the measured performance parameter associated with the particular user to a server computing device associated with the plurality of exercise stations. By one approach, the server computing device is configured to determine one or more performance metrics of the particular user based at least in part on a comparison between the at least one measured performance parameter associated with the particular user and a target parameter determined by the server computing device and based, at least in part, on a data set including the measured performance parameters associated with each of user of each exercise station during the exercise period.

To compare a set of exercisers or users, the system may determine a target cadence parameter by, in part, identifying an upper threshold cadence and a lower threshold cadence of the data set (for example, based on percentile calculations of the performance parameters of the set of exercisers), and calculating an expected cadence during the exercise period based on the upper and lower threshold cadences. In one illustrative embodiment, the system sets the expected cadence to equal the lower threshold cadence when the lower threshold cadence is below a predetermined value, such as, for example, about 10 rotations per minute during the exercise period. In addition, the system may set the expected cadence to equal to the higher threshold cadence when the lower threshold cadence is above the predetermined value, such as, about 10 rotations per minute, during the exercise period. In some forms, the expected cadence may be filtered for consistency. By some approaches, the system, such as the server computing device, also is configured to analyze and identify one or more sustained regions of the expected cadence, which includes intervals of the exercise period having a cadence change of less than a predetermined value, such as, for example less than about three rotations per minute between a first window or track point and a second window or track point. Once the sustained regions are identified, a target cadence may be calculated by averaging the expected cadence over the identified time interval for each of the identified sustained regions.

Once the target cadence of each sustained performance regions is identified, the system determines the performance metric of each user by comparing the performance parameter of the particular user and the target cadence over the sustained regions to determine a percentage match therebetween. For example, the performance metric may be determined by identifying an error rate that is calculated as a percentage difference between the target cadence and the performance parameter of the particular user. In addition, in some configurations, a control circuit or server computing device sends or communicates the determined performance metrics of a particular user to an electronic user device associated therewith.

In some embodiments, the system may also include one or more biometric sensors configured to sense at least one biometric parameter or physical characteristic of the particular user, wherein the at least one biometric parameter or physical characteristic of the particular user includes one or more of a heart rate of the particular user, respiration of the particular user, and hydration of the particular user. In some embodiments, the one or more biometric sensors may include an accelerometer coupled to the particular user to measure, for example, the frequency of motions of the user. The one or more biometric sensors may be in addition to, or alternative to, the sensors described above. In some forms, the information gathered from the one or more biometric sensors may constitute the measured performance parameters and be compared to the target cadence or target parameter to determine the performance metric of the user. Additionally or alternatively, the information gathered from these sensors may be compared over time with the performance metrics and the selections played during the exercise period to help further identify selections that motivate or facilitate improved athletic performance. So configured, this information can be communicated to the electronic user device associated with the particular user.

In one illustrative embodiment, the system further includes a speaker system configured to play music to the multiple users of exercise equipment at exercise stations, such as stationary bikes, during an exercise period. In another embodiment, the system may communicate with an electronic user device and send music thereto, which in turn may be communicated to one or more audio devices associated therewith, such as, for example, headphones or speakers. In addition, the control circuit, server computing device, or electronic user device may be communicatively coupled to a database having a selection playlist stored therein.

In accordance with the following examples, the exercise equipment or exercise stations of the present disclosure may be described relating to stationary bicycles for illustrative purposes. However, it should be understood that the discussion regarding the exercise equipment and/or exercise stations may encompass any example exercise equipment such as an elliptical machine, a rowing machine, a treadmill, various weight machines, among others. In addition, in some forms, the systems, apparatuses, and methods of the present disclosure may encompass measuring performance parameters of users that are not using exercise equipment. For example, the user may be running on a trail, or performing other fitness activities such as aerobics that would not otherwise require dedicated exercise equipment.

Referring now to FIG. 1, a system 100 for evaluating performance of a particular user 114 during an exercise period typically includes a plurality of exercise stations, such as stationary bikes 102, each associated with a user 114, where each stationary bike includes at least one flywheel 106 and at least one sensor 104, such as, an optical sensor 122, a power meter 130, or a magnetic flywheel sensor 108. In operation, each sensor 104 is configured to measure at least one performance parameter associated with each user 114 of each stationary bike. For example, in embodiments of the system 100 including a magnetic flywheel sensor 108, the measured performance parameter may be the rotations per minute or total rotations of the flywheel 106. The sensors 104 of the exercise equipment, such as the stationary bikes 102, are operatively coupled to communication circuitry of the equipment, which, in turn communicates the at least one measured performance parameter associated with each user 114 to a server computing device 120 associated with the plurality of stationary bikes 102.

As shown, one of the stationary bikes 102 also may include a bike frame 134, a bike seat 136, and bike handlebars 138, as is typically in such stationary exercise equipment. The bike 102 also includes a pair of pedals 128 that may have a power meter 130 associated therewith. Further, the stationary bike 102 may include a control circuit 110 in communication with the sensors 104 incorporated therein. By one approach, the control circuit 110 is in wired or wireless communication with network 118, such that the measured performance parameters may be sent to the server computing device 120 via the network 118.

In one illustrative embodiment, the server computing device 120 is configured to determine one or more performance metrics of the particular user 114 of a particular stationary bike based at least in part on a comparison between the at least one measured performance parameter associated with the particular user 114 and a target cadence. As used herein, the target cadence is typically determined based at least in part on a data set including the measured performance parameters associated with each user 114 of each stationary bike during the exercise period. We note that the measured performance parameters are typically obtained from active equipment such that equipment not assigned or designated to a user 114 will not be included in the data set including the measured performance parameters of each user 114.

As suggested above, the sensors 104 typically measure at least one performance parameter of each user 114, though the measured parameter may be different depending on the sensors 104 incorporated into the system 100. In operation, the sensors 104 (including the optical sensor 122, the power meter 130, and/or the magnetic flywheel sensor 108) may measure, for example, a pedal cadence of each user 114, a rotational speed of the at least one flywheel of each stationary bike, a power output of each stationary bike, and leg movement of each user 114. The obtained data during the exercise period is analyzed collectively as a data set.

As shown in FIG. 1, the example system 100 also includes a speaker system 140, which is configured to play music for users 115 of the stationary bikes 102 during the exercise period. The music played may be provided to the speaker system 140 from the database 124 of music, which also may include playlist, artist information, and tempo information among many other details. Indeed, in one illustrative approach, the server computing device 120 is communicatively coupled to the database 124 having a selection playlist stored therein such that the server computing device 120 may receive the playlist, artist information, and tempo information of the selections played.

Figure 2:
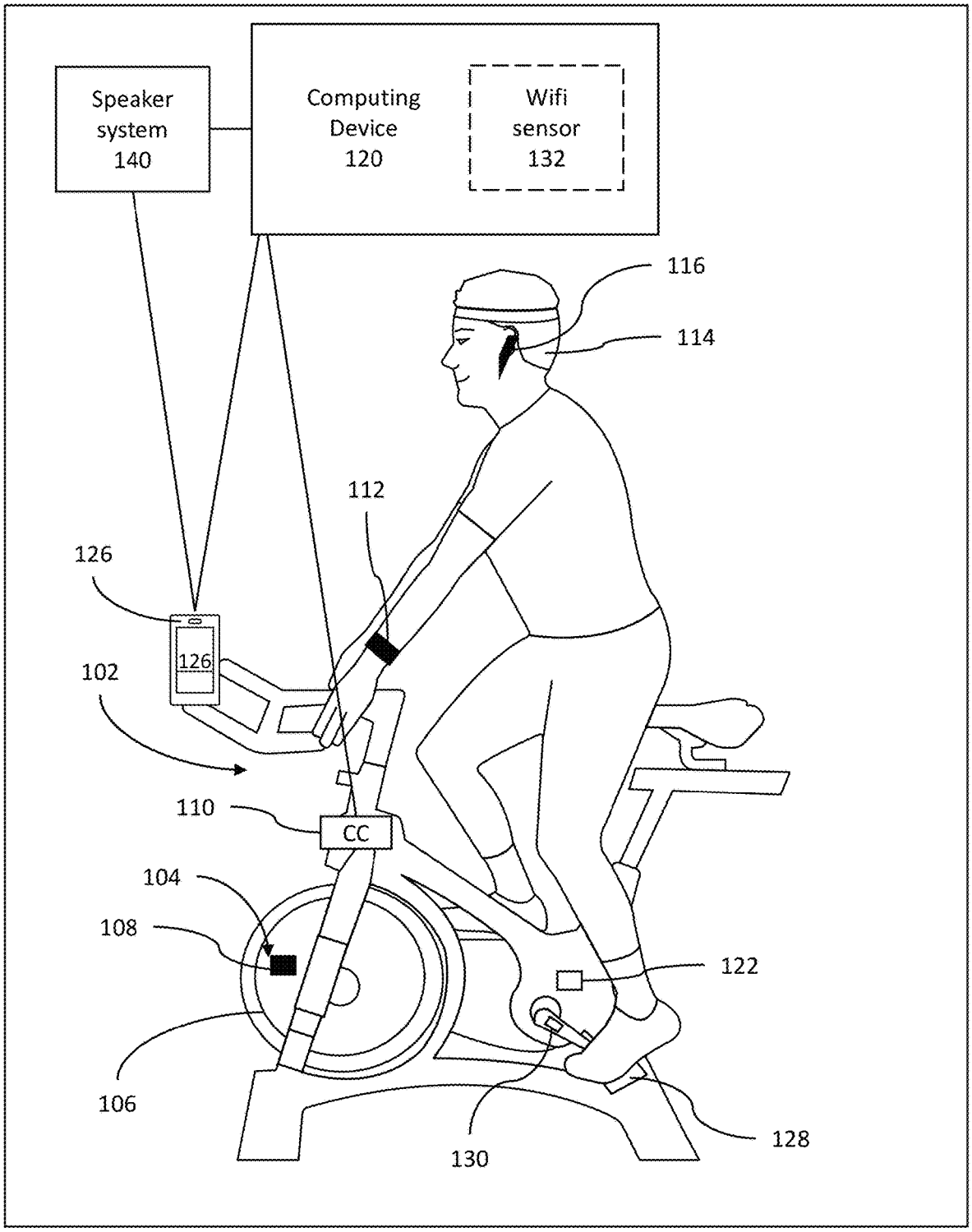
FIG. 2 is a schematic block diagram showing a user on a stationary bike, the stationary bike having a flywheel, control circuitry, and a sensor for detecting one or more performance parameters, in accordance with some embodiments.

We note that while FIGS. 1 and 2 include a speaker system 140, the systems 100 and 200 (discussed further below) also may employ other audio listening devices, such as headphones. Indeed, as shown in FIG. 2, the speaker system 140 and computing device 120 may be communicatively coupled to the electronic user device 126, which may in turn be coupled headphones 116 associated with the user 114. So configured, the music selection may be played through the headphone 116 of the user 114 while exercising.

As suggested above, the data set from a plurality of users 115 of the stationary bikes 102 may be analyzed to evaluate performance of an individual user 114. To that end, the server computing device 120 may be configured to identify an upper threshold cadence and a lower threshold cadence of the data set to calculate an expected cadence during the exercise period based on the upper and lower threshold cadences. More particularly, the expected cadence is generally set as equal to the lower threshold cadence when the lower threshold cadence is below a predetermined threshold, such as, for example, about 10 rotations per minute during the exercise period. Further, the expected cadence is generally set to the higher threshold cadence when the lower threshold cadence is above the predetermined threshold, such as, about 10 rotations per minute during the exercise period. The expected cadence may be calculated in this manner to, for example, eliminate periods of downtime during the exercise from the comparison.

Further, the server computing device 120 also may identify one or more sustained regions of the expected cadence. As used herein, the sustained region is typically defined as an interval of the exercise period of at least a predetermined length of time and having no significant cadence change, such as lacking a cadence change of greater than about 3 rotations per minute between adjacent windows of time, 5 rotations per minute between three adjacent windows of time, among others. Accordingly, in one illustrative approach, each sustained region may be defined as an interval of the exercise period having a cadence change of less than about 3 rotations per minute between first and second track points and lasting at least 30 seconds. So configured, the exercise intervals of rapid change in rotations per minute are not identified as sustained regions for the comparison calculations of each user 114, as described in further detail hereinafter.

In addition, the server computing device 120 is configured to determine the target cadence during each sustained region based at least in part on an average value of the expected cadence over each sustained region such that a single value is obtained for the target cadence. In some embodiments, the server computer 120 calculates an error rate that forms the basis of the performance metrics communicated to the users 114. In operation, the error rate is typically calculated as a percentage difference between the target cadence and the pedal cadence of the particular user. For example, as shown below, an error rate of a user 114 may be calculated and used to determine an on-beat percentage match to indicate how often the user 114 remained near the target cadence of the sustained regions:

$$OnBeat\ \text{Percentage Match} = \left(1 - \frac{|TargetCadence - UserCadence|}{TargetCadence}\right)$$

Figure 10:
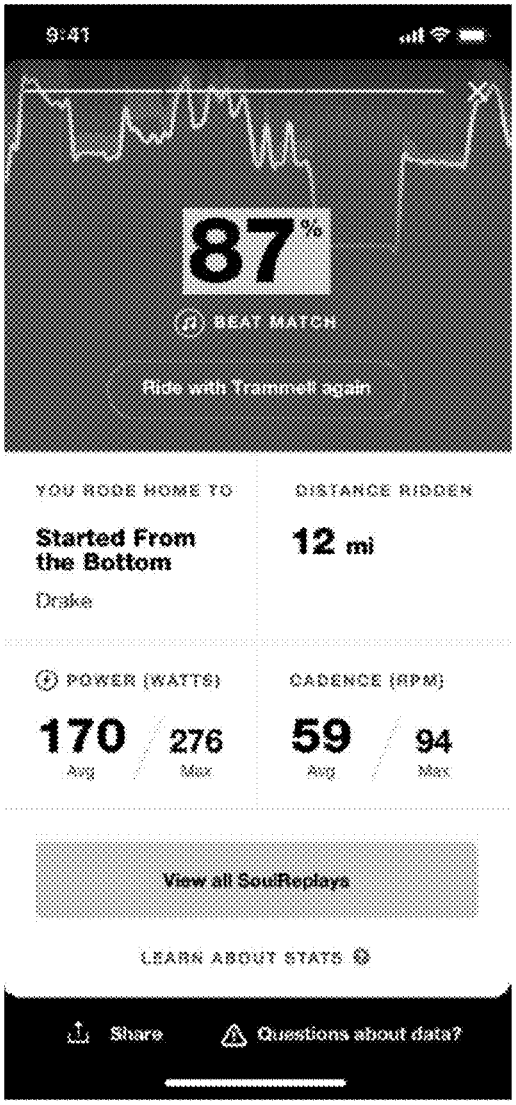
FIGS. 10 and 11 are illustrative screen shots of a user interface of an electronic user device in accordance with several embodiments.
Figure 11:
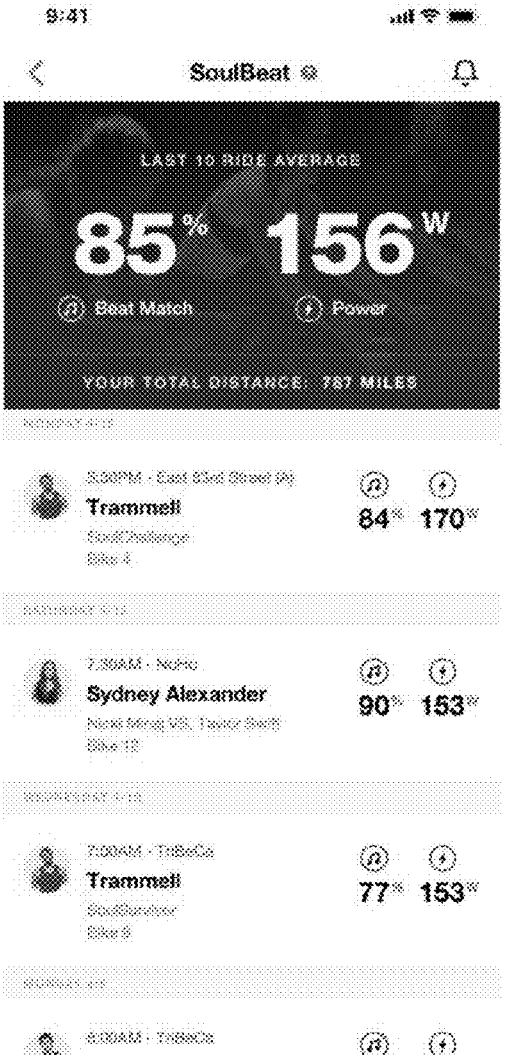

To motivate and provide information to the various users, the server computer 120 also is configured to communicate the one or more determined performance metrics, such as the on-beat percentage match of the particular user 114, to an electronic user device 126 associated with the particular user 114. Such an exemplary display is illustrated in FIGS. 10 and 11 and will be discussed in more detail below.

Turning now to FIG. 2, showing an example system in accordance with the present disclosure with a single user 114 illustrated on a stationary bike 102. As shown, the user 114 has a biometric sensor 112 associated therewith. By one approach, the biometric sensor 112 is configured to measure at least one biometric parameter of the user 114, such as, a heart rate of the user 114, respiration of the user 114, and/or hydration of the user 114. Further, this information may be associated with the user 114 and provided to the computing device 120 to supplement the analysis of performance.

Figure 4:
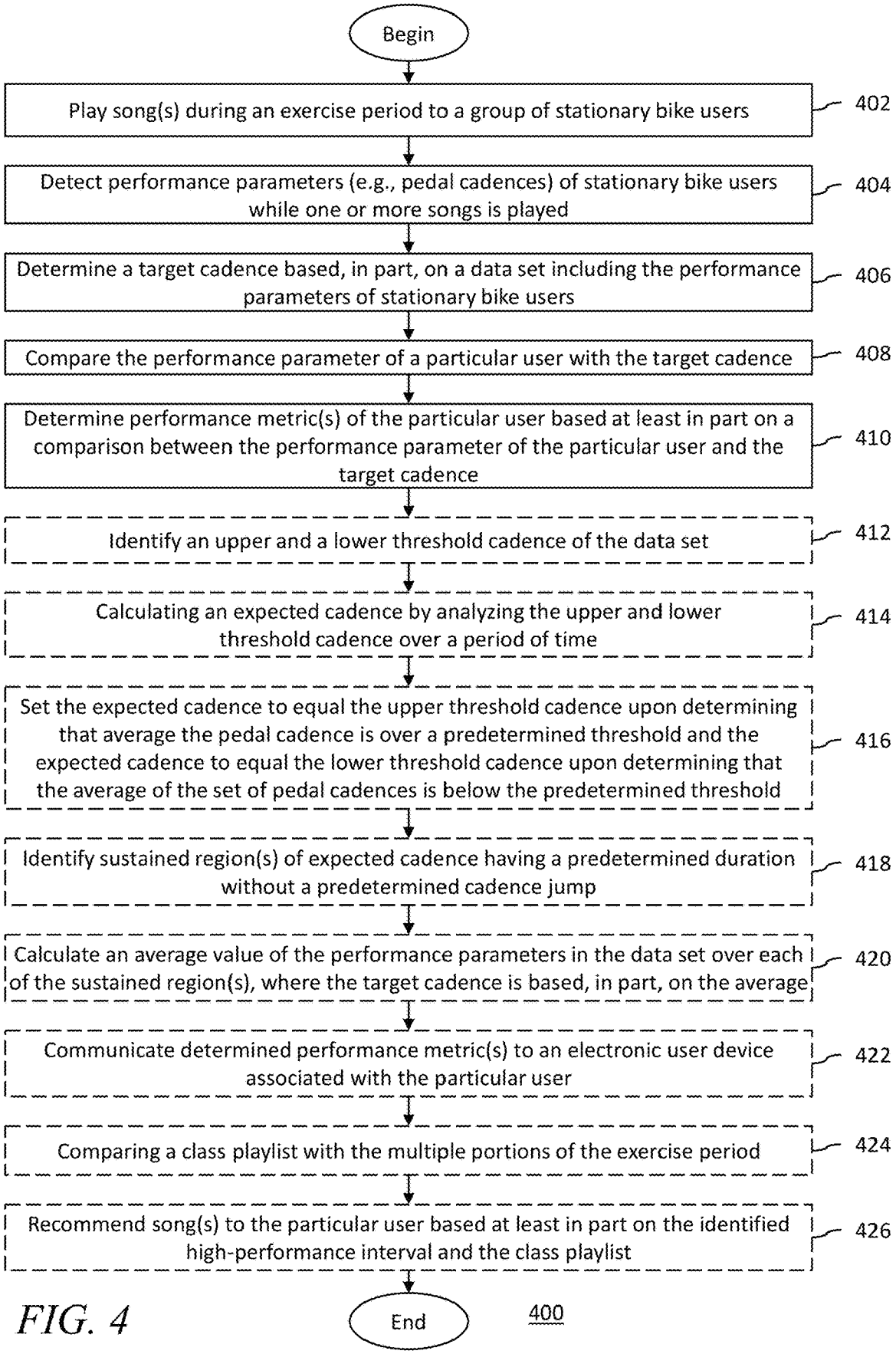
FIG. 4 is a simplified flow diagram showing another example method for evaluating performance of a user during an exercise period in accordance with several embodiments.

In operation, a method 400 of evaluating performance of a particular user during an exercise period is illustrated in FIG. 4 and may employ one or more systems (e.g., systems 100 and/or 200) described herein. For illustrative purposes, the method 400 will be described with respect to a user of a stationary bike. In step 402, the method includes playing, such as via a speaker system, one or more selections to a plurality of stationary bike users associated with a plurality of stationary bikes. In one illustrative approach, the method includes detecting 404 (such as via sensors associated with the plurality of stationary bikes) a performance parameter of each stationary bike user while one of the one or more selections is playing and determining 406 (such as via a processor operatively coupled to the sensors) a target cadence based at least in part on a data set including the performance parameter of each stationary bike user during the exercise period. In step 408, the method also includes comparing the performance parameter of the particular user and the target cadence, and in step 410, determining one or more performance metrics of the particular user based at least in part on the comparison between the performance parameter of the particular user and the target cadence.

As discussed above, the performance parameter of each stationary bike user may include one or more of a pedal cadence of each stationary bike user, a rotational speed of the flywheel of each stationary bike, a power output of each stationary bike, and leg movement of each stationary bike user.

By one approach, the method 400 also includes identifying 412 an upper threshold cadence and a lower threshold cadence of the data set and calculating 414 an expected cadence during the exercise period based at least in part on the upper threshold cadence and the lower threshold cadence. For example, the expected cadence may be set 416 to equal the lower threshold cadence when the lower threshold cadence is below a predetermined threshold, such as, about 10 rotations per minute during the exercise period, and set to equal the higher threshold cadence when the lower threshold cadence is above the predetermined threshold during the exercise period.

To further analyze the performance of the set of users, such as users 115, the method also may include the step of identifying 418 one or more sustained regions of the expected cadence. As suggested above, a sustained region is typically defined as an interval of the exercise period having at least a predetermined length, such as, for example, 30 seconds and few significant cadence changes or jumps, such as a cadence change of less than about 3 rotations per minute between first and second track points.

In some illustrative embodiments, the method 400 also includes step 420 of calculating an average value of the measured performance parameters in the data set over each sustained region of the expected cadence. In operation, the target cadence is generally based at least in part on the average value. Further, the method 400 also may include a step of providing the performance metric that is an error rate defined as a percentage difference between the target cadence and the pedal cadence of the particular user.

In step 422, the method, in some forms, includes communicating, via communication circuitry operatively coupled to the processor, the one or more determined performance metrics of the particular user to an electronic user device, such as device 126, associated with the particular user 114. By some approaches, the method also includes comparing 424 a class playlist with multiple portions of the exercise period and recommending 426 song(s) or selection(s) to a particular user based, at least in part, on an identified high-performance interval and the class playlist. In this manner, a user can get information on what songs or selections contribute to or facilitate improved performance.

Turning now again to FIG. 2, a system 200 for measuring performance of a user associated with a stationary bike 102 during an exercise period is provided. Similar to the system 100 described above, the stationary bike 102 includes a number of sensors 104. Further, the user 114 is depicted in position on the bike 102 and the system 200 includes an electronic user device 126, such a mobile phone, that has been associated with the bike 102. As suggested above, the sensors 104 (such as, an optical sensor 122, a power meter 130, and a magnetic flywheel sensor 108) are configured to measure at least one performance parameter of the user 114 associated with the stationary bike 102 during the exercise period. In addition, the control circuit 110 associated with the user, the computing device 120, and/or the electronic user device 126 are generally communicatively coupled to the sensors 104. For example, the control circuit 110 may be coupled to the sensors 104 either by a wired, or wireless connection. In addition, the control circuit 110, computing device 120, and/or the electronic user device 126 may be configured to determine, by a processor, at least one performance metric based at least in part on a comparison between the at least one performance parameter measured by the sensor and a target cadence. In one illustrative approach, the system 200 communicates, by communication circuitry, the at least one determined performance metric to the electronic user device. In another illustrative embodiment, the electronic user device 126 may determine the performance metric and display it on an interface thereof. In one illustrative approach, the target cadence is calculated at least in part based on a tempo of a selection played during the exercise period.

Similar to system 100, the system 200 may be employed to analyze a group of users, whether located in a single exercise location or studio or disbursed in a number of different locations. Accordingly, the system 200 may identify at least one parameter including one or more of a pedal cadence of the user 114, a rotational speed of a flywheel of the stationary bike 102, a power output of the stationary bike 102, and leg movement of the user 114.

In addition to the metric described above, the system 200 also may be employed to determine the performance metric as an error rate defined as a percentage difference between the target cadence and the measured performance parameter, such as pedal cadence, of the user 114. In one illustrative configuration, the control circuit 110 and one or more of the sensors 104 are configured to be detachably coupled to the stationary bike.

Figure 3:
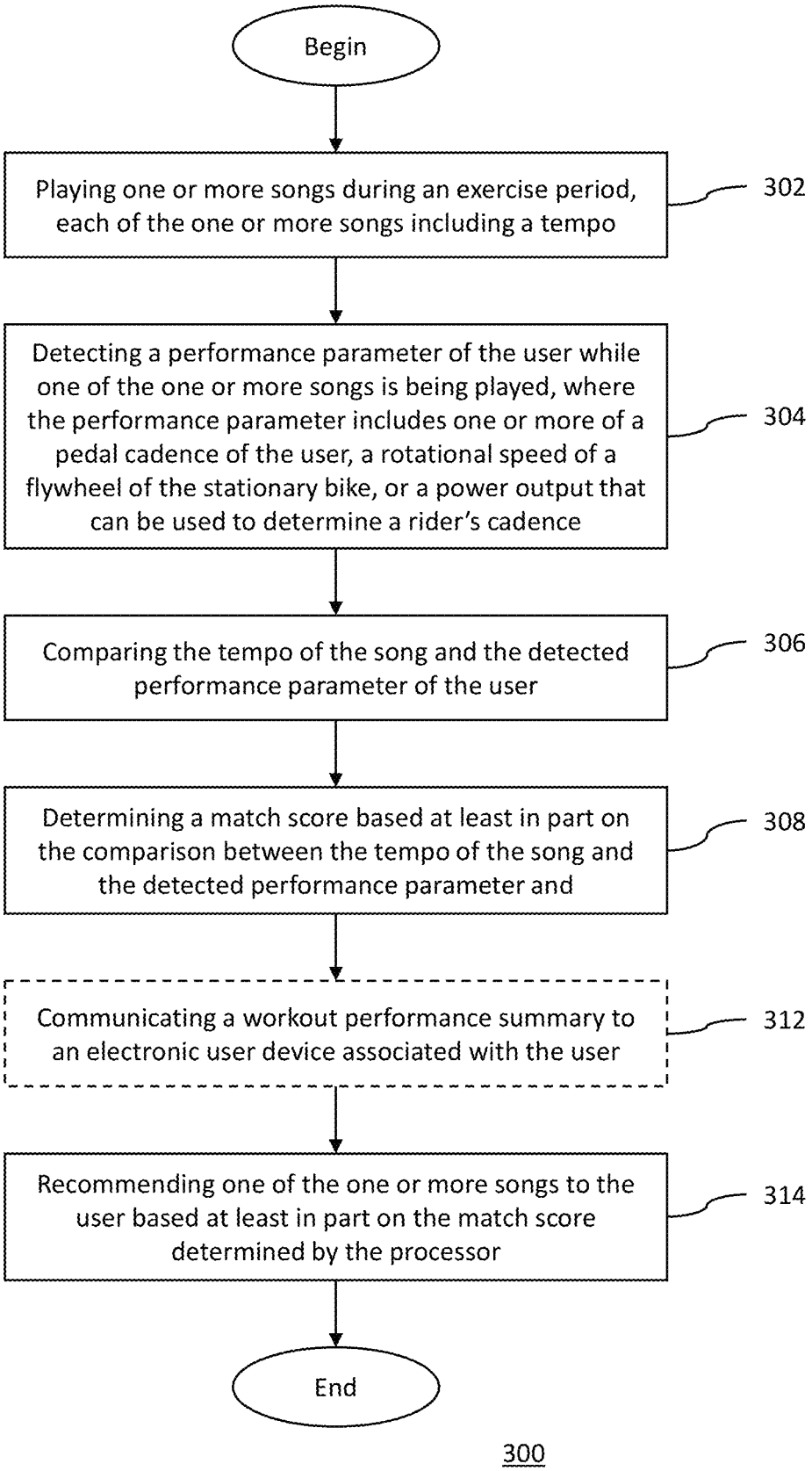
FIG. 3 is a simplified flow diagram showing an example method for evaluating performance of a user during an exercise period, in accordance with some embodiments.

Turning now to FIG. 3, illustrative method 300 is shown and may be employed with system 100 or 200 described herein. In one configuration, method 300 for evaluating performance of a user of a stationary bike includes playing 302, via a speaker associated with the stationary bike, one or more selections during an exercise period, each of the one or more selections including a tempo, and detecting 304, via a sensor operatively coupled to the stationary bike, a performance parameter of the user while one of the one or more selections is playing. In addition, the method also compares 306, via a processor operatively coupled to the sensor, the tempo of each of the one or more selections and the detected performance parameter of the user. Further, the method 300 includes determining 308, via the processor, a match score for each of the one or more selections, the match score based at least in part on the comparison between the tempo of each selection and the detected performance parameter and recommending 314 one of the one or more selections to the user based at least in part on the match score determined by the processor. For example, the match score may be an on-beat percentage match indicating a percentage of time during that exercise period that the detected performance parameter of the user corresponds with the tempo of the selections played. In some configurations, the step of recommending 314 includes communicating a notification signal to an electronic user device associated with the user, the notification signal configured to cause the electronic user device to display the recommended selection to the user.

Similar to embodiments discussed above, the performance parameter typically includes one or more of a pedal cadence of the user, a rotational speed of a flywheel of the stationary bike, a power output of the stationary bike, and leg movement of the user, which may be obtained via sensors including one or more of a power meter, an optical sensor, and a magnetic flywheel sensor. In other forms, the performance parameter may be obtained via a biometric sensor coupled to the user as described above.

In some configurations, the method 300 also includes the step of communicating 312, via communication circuitry coupled to the processor, a workout performance summary to an electronic user device associated with the user. The workout performance summary may include information associated with the exercise period, such as performance metrics, revolutions-per-minute (RPM), distance ridden (e.g., in embodiments including stationary bikes), power generated, and/or heartrate, among many other options.

Figure 5:
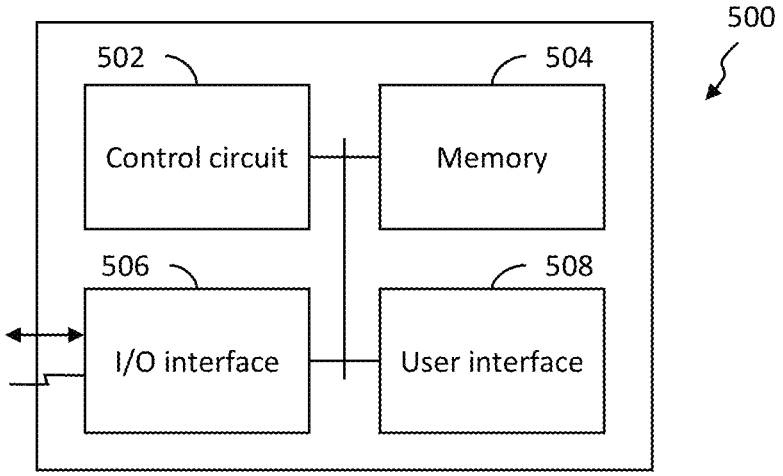
FIG. 5 is schematic diagram showing an example control system having one or more control circuits, a memory, an input/output (I/O) interface, and a user interface, in accordance with some embodiments.

Referring to FIG. 5, an example system 500 is illustrated that may be used for a variety of implementations, in accordance with some embodiments described herein to monitor or evaluate athletic or fitness performance of a user. One or more components of the system 500 may be used to implement any system, apparatus or device mentioned above, or parts of such systems, apparatuses or devices, such as for example any of the above or below mentioned control circuits, electronic user devices, sensor(s), databases, platforms, parts thereof, and the like. However, the use of the system 500, or any portion thereof is, certainly not required.

By way of example, the system 500 may include one or more control circuits 502, memory 504, input/output (I/O) interface 506, and/or user interface 508. The control circuit 502 typically comprises one or more processors and/or microprocessors, similar to the server computer 120 and control circuit 110 mentioned above. The memory 504 stores the operational code or set of instructions that is executed by the control circuit 502 and/or processor to implement the functionality of the systems and devices described herein, parts thereof, and the like. In some embodiments, the memory 504 may also store some or all of particular data in a data set, such as the measured performance data, that may be needed to provide a comparison of a user's performance data.

It is understood that the control circuit 502 and/or processor may be implemented as one or more processor devices as are well known in the art. Similarly, the memory 504 may be implemented as one or more memory devices as are well known in the art, such as one or more processor readable, and/or computer readable media and can include volatile and/or nonvolatile media, such as RAM, ROM, EEPROM, flash memory and/or other memory technology. Further, the memory 504 is shown as internal to the system 500; however, the memory 504 can be internal, external or a combination of internal and external memory. The system 500 also may include a database (not shown in FIG. 5) as internal, external, or a combination of internal and external to the system 500. Additionally, the system typically includes a power supply (not shown), which may be rechargeable, and/or it may receive power from an external source. While FIG. 5 illustrates the various components being coupled together via a bus, it is understood that the various components may actually be coupled to the control circuit 502 and/or one or more other components directly.

Generally, the control circuit 502 and/or electronic components of the system 500 can comprise fixed-purpose hard-wired platforms or can comprise a partially or wholly programmable platform. These architectural options are well known and understood in the art and require no further description here. The system and/or control circuit 502 can be configured (for example, by using corresponding programming as will be well understood by those skilled in the art) to carry out one or more of the steps, actions, and/or functions described herein. In some implementations, the control circuit 502 and the memory 504 may be integrated together, such as in a microcontroller, application specification integrated circuit, field programmable gate array or other such device, or may be separate devices coupled together.

The I/O interface 506 allows wired and/or wireless communication coupling of the system 500 to external components and/or systems. Typically, the I/O interface 506 provides wired and/or wireless communication (e.g., Wi-Fi, Bluetooth, cellular, RF, and/or other such wireless communication), and may include any known wired and/or wireless interfacing device, connection protocol, circuit and/or connecting device, such as, but not limited to, one or more transmitter, receiver, transceiver, etc. For example, the performance data of the user or users may be provided to the control circuit or central computer 120 either directly or indirectly, such as through a network 118. In some configurations, the network 118 communicates the performance information to the remote server computing device 120, which maintains the information and conducts analysis of the performance data.

The user interface 508 may be used for user input and/or output display. For example, the user interface 508 may include any known input devices, such one or more buttons, knobs, selectors, switches, keys, touch input surfaces, audio input, and/or displays, etc. Additionally, the user interface 508 includes one or more output display devices, such as lights, visual indicators, display screens, etc. to convey information to a user, such as but not limited to the performance details, recommended listening selections, and/or historical data. Similarly, the user interface 508 in some embodiments may include audio systems that can receive audio commands or requests verbally issued by a user, and/or output audio content, alerts and the like. For example, the user interface 508 may be used to motivate users to continue improving on their reported performance metrics.

Referring now to FIGS. 6-11, an example calculation of the performance metric of a particular user during an exercise period will be described where the measured performance parameter is a pedal cadence. However, in other forms, a number of alternative performance parameters of a user during an exercise period may be used in connection with the below-described calculation. As described above, a system for evaluating performance of one or more users during an exercise period may include a plurality of stationary bikes, at least one sensor operatively coupled to each of the plurality of stationary bikes (where the sensors measure the pedal cadence associated with a particular user of a particular stationary bike), and communication circuitry operatively coupled to the bike sensors such that they can communicate the measured pedal cadence associated with each of the users to a server computing device associated with the plurality of stationary bikes. By one approach, the server computing device is configured to store the measured pedal cadence of each user over the exercise period as a data set in a memory thereof.

Figure 6:
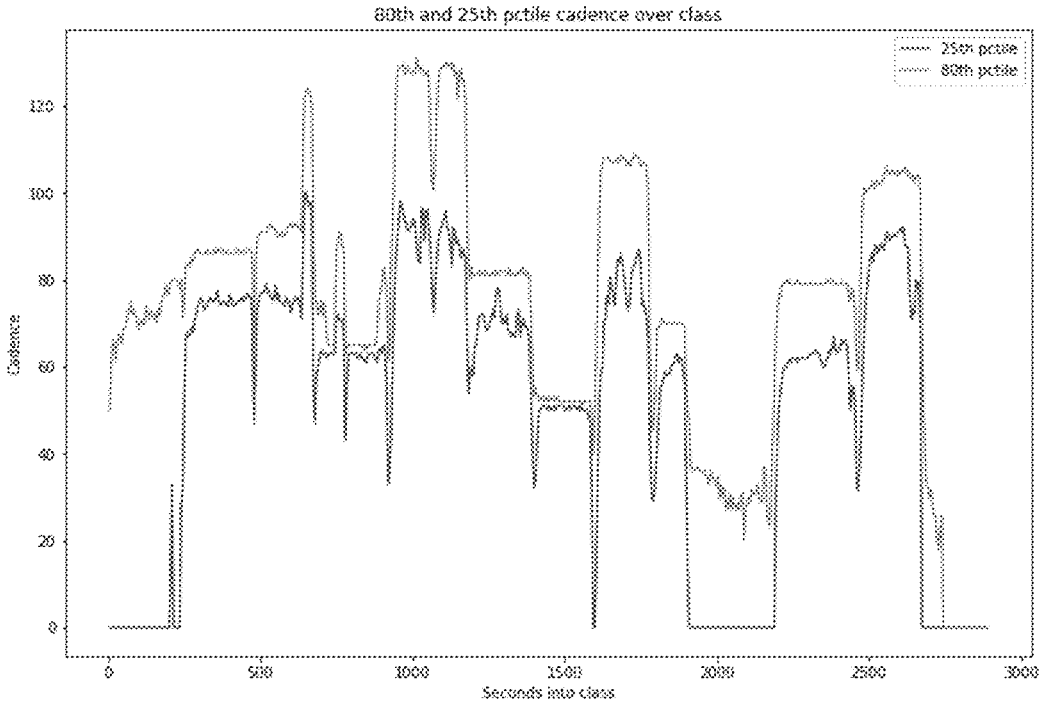
FIGS. 6-8 show illustrative graphs demonstrating how a target cadence, an expected cadence, and sustained performance regions are identified.

As suggested above, the data set from the plurality of users may be analyzed to evaluate performance of the individual users. To that end, the server computing device may be configured to identify an upper threshold cadence and a lower threshold cadence of the data set of pedal cadences. As shown in FIG. 6, the measured performance parameters of the users in the data set may be segregated into percentiles such that the upper threshold may be selected as the $80^{th}$ percentile pedal cadence of the users and the lower threshold may be selected as the $25^{th}$ percentile pedal cadence of the users. In other forms, the upper and lower threshold cadences may be selected as desired to correspond with other percentile pedal cadences in the data set, such as $75^{th}$ or $90^{th}$ percentile for the upper threshold and/or $20^{th}$ or $30^{th}$ percentile for the lower threshold.

Figure 7:
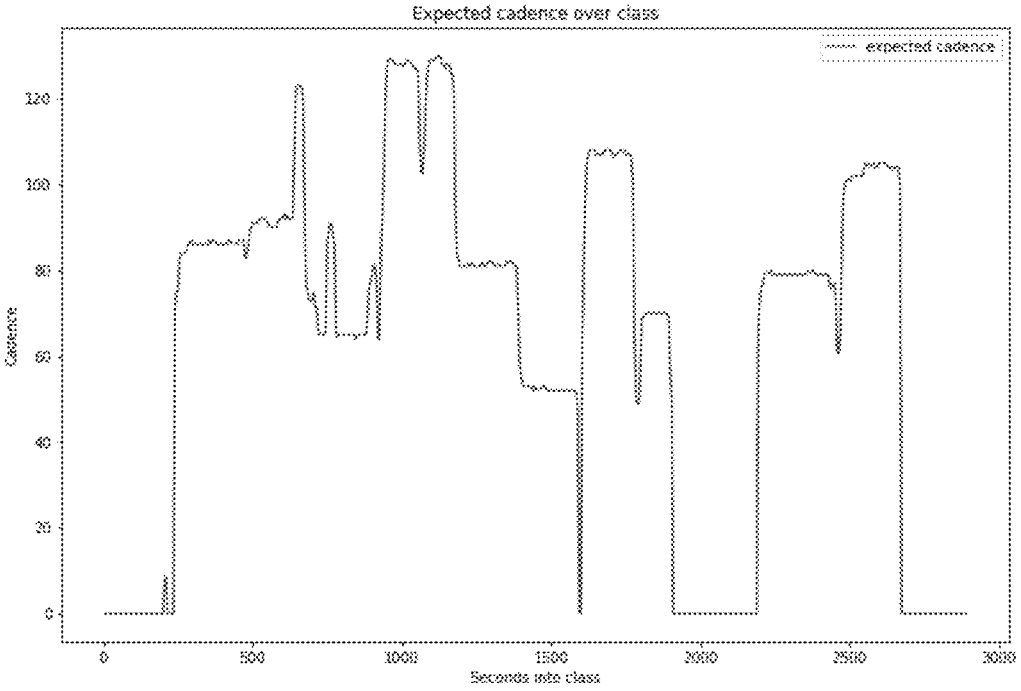
Figure 8:
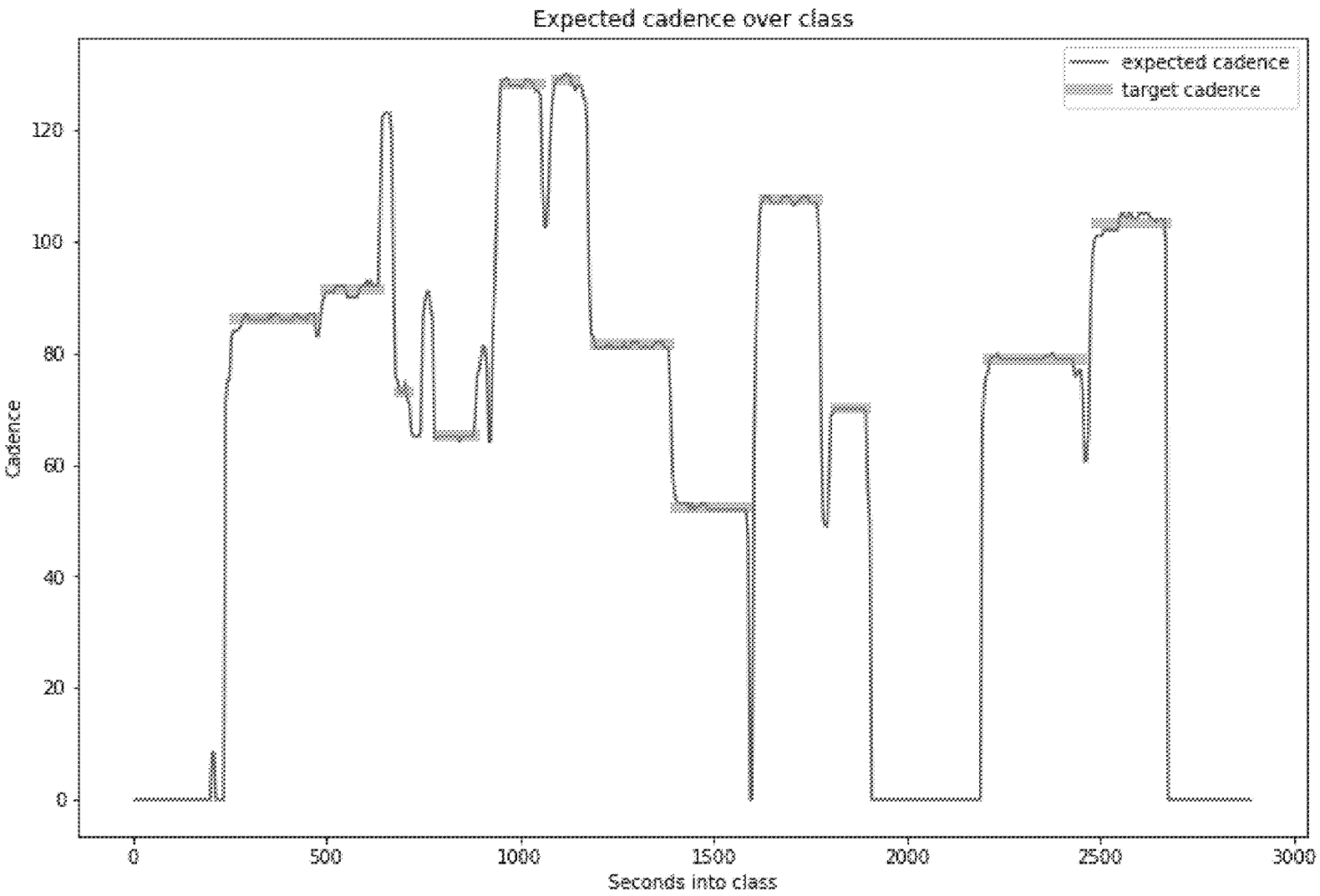

FIG. 7 shows an expected cadence calculated during the exercise period based at least in part on the upper and lower threshold cadences as shown in FIG. 6. More particularly, the expected cadence is generally set as equal to the lower threshold cadence when the lower threshold cadence is below a predetermined threshold, such as, for example, about 10 rotations per minute during the exercise period. Further, the expected cadence is generally set to the higher threshold cadence when the lower threshold cadence is above the predetermined threshold, such as, about 10 rotations per minute during the exercise period. The expected cadence may be calculated in this manner to, for example, eliminate periods of downtime during the exercise from the comparison. Additionally, the calculated expected cadence may be filtered to determine a more precise target cadence, as discussed further below. In other forms, the expected cadence may be based on an average pedal cadence of the users such that the upper and lower threshold cadences are not required Next, as shown in FIG. 8, the server computing device may also identify one or more sustained regions of the expected cadence. For example, as described above, a sustained region is typically defined as an interval of the exercise period having at least a predetermined length of time and having no significant cadence change, such as lacking a cadence change of greater than about 3 rotations per minute between adjacent windows of time, 5 rotations per minute between three adjacent windows of time, among others. Accordingly, in one illustrative approach, each sustained region may be defined as an interval of the exercise period having a cadence change of less than about 3 rotations per minute between first and second track points and lasting at least 30 seconds. So configured, the exercise intervals of rapid change in rotations per minute are not identified as sustained regions for the comparison calculations, as described in further detail hereinafter. In FIG. 8, the sustained regions are identified as the highlighted, substantially flat, intervals where the cadence remains generally consistent over a time period.

In addition, the server computing device is configured to determine the target cadence during each sustained region based at least in part on an average value the expected cadence over each sustained region. Once the target cadence has been calculated, any individual user's pedal cadence may be compared to the target cadence to determine one or more performance metrics during the exercise period. For example, the server computing device may calculate an error rate between the pedal cadence of a particular user and the target cadence. Upon calculating the error rate, the error rate may then be subtracted from one to determine an on-beat percentage match. In other words, the on-beat percentage match indicates what percentage of time the particular user was near the target cadence during the exercise period in the sustained regions. So configured, performance metrics such as the on-beat percentage match may inform a user whether they are underperforming, over performing, or whether they are comfortable at their current pedal cadence.

Figure 9:
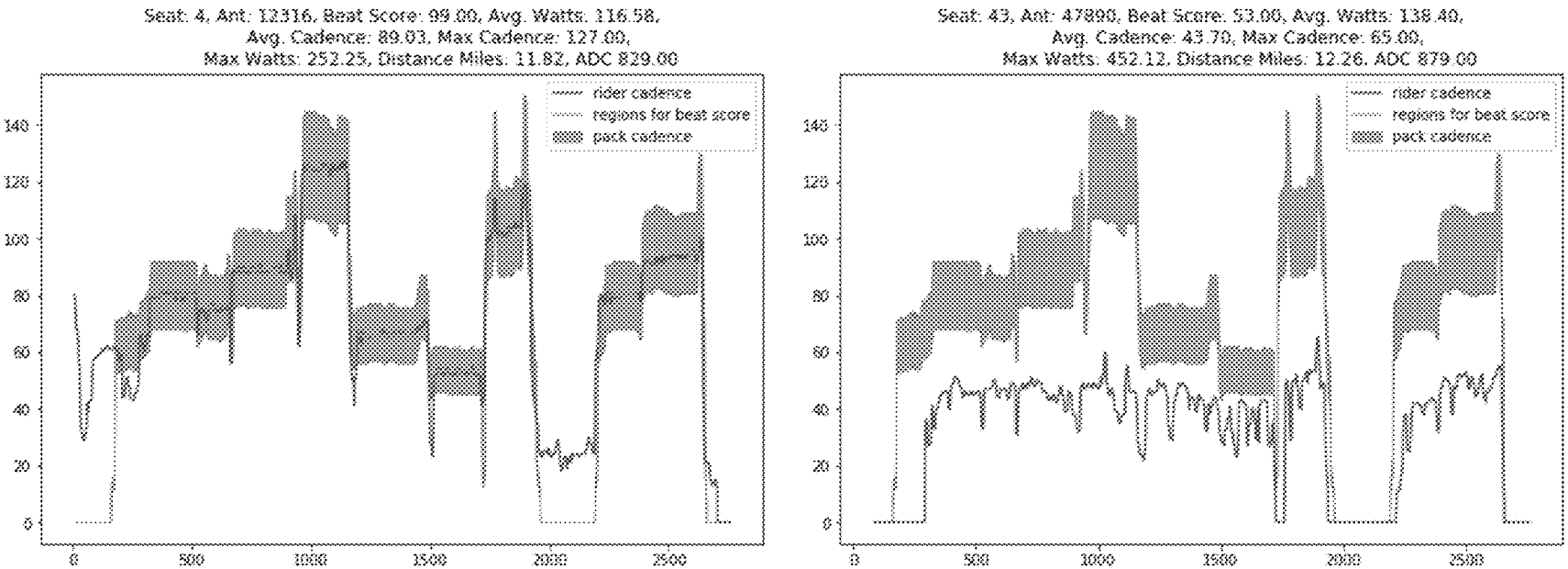
FIG. 9 show illustrative graphs with exemplary results for two different participants from a group exercise class.

FIG. 9 includes a left graph and a right graph, each graph indicating the measured performance parameters of a particular user. As illustrated, each graph shows the individual user cadence compared with the sustained regions (i.e., regions for beat score). Above the left graph, the "Beat Score" of 99.00 indicates the on-beat percentage match of that particular user. In other words, the particular user measured in the left graph was on-beat approximately 99 percent of the time in the sustained regions during the exercise period. In the right graph, the pedal cadence of another particular user was below the target cadence during the exercise period. As shown, the "Beat Score" of the user in the right graph was only 53.00 indicating an on-beat percentage match of 53 percent.

As illustrated in FIG. 6-9, the performance parameter measured is the pedal cadence of each user. However, it should be understood that the method of calculating the higher and lower thresholds, expected value (e.g., the expected cadence), and the target value (e.g., the target cadence) can be used in connection with any of the performance parameters, including those that may be measured via the biometric sensors, discussed herein to measure the performance of any individual user during an exercise period.

FIGS. 10 and 11 show example screen shots of a user interface of an electronic user device in accordance with several embodiments of the present disclosure. In some forms, as described above, a processor of the server computing device is configured to cause communication of a performance summary to an electronic user device of a particular user after the exercise period. For example, the performance summary may display performance metrics, such as, an on-beat percentage match (shown in FIGS. 10 and 11 as the "Beat Match"), average revolutions-per-minute (RPM), distance ridden, power generated, and/or heartrate, among many other options. Further, receiving such feedback can be motivational for users such that participants strive to improve their reported performance metrics. In addition, in embodiments of the present disclosure where the users measured performance parameter is compared to a tempo of one or more songs played during the exercise period, the user interface of the electronic user device may be configured to display recommended songs and/or music types based at least in part on which songs the user had the highest "Beat Match" during the exercise period. In other forms, the example screen shots in FIGS. 10 and 11, or other screens of the electronic user device may include visual representations of the user's performance metric such as the graphs shown in FIG. 9.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A system for evaluating athletic performance during an exercise period, the system comprising:

an exercise station;

a sensor communicatively coupled to the exercise station and configured to measure a performance parameter, wherein the exercise station comprises a pair of pedals and a flywheel, and wherein the performance parameter is one or more of a pedal cadence, a rotational speed of the flywheel, or a power output; and a display unit configured to display a performance metric, wherein the display unit displays the performance metric at an end of the exercise period, the performance metric corresponding to a percentage difference between a target parameter and the performance parameter during the exercise period;

wherein the exercise station is a stationary bike, the sensor is a power meter, and the performance parameter is a power output measured during one or more sustained regions of the exercise period, and the target parameter is a target power output calculated at least in part based on a tempo of an audio selection played during each of the one or more sustained regions of the exercise period.

2. The system of claim 1, wherein the sensor is communicably coupled to a processor, the sensor being configured to transmit the performance parameter to the processor during the exercise period.

3. The system of claim 2, wherein the processor is communicably coupled to the display unit, the processor being configured to:

calculate the target parameter during the exercise period, transmit the target parameter to the display unit during the exercise period, calculate the performance metric at the end of the exercise period, and transmit the performance metric to the display unit at the end of the exercise period.

4. The system of claim 1 further comprising:

a memory storing a plurality of files, wherein a first portion of at least one of the files is an audio file associated with a sustained region of the exercise period;

an input/output interface configured to receive performance data measured at the exercise station and to store the received performance data in the memory; and a processor communicably coupled to the sensor, wherein the processor is configured to:

calculate the target parameter for the sustained region of the exercise period based on the tempo of the audio selection of the first portion of the audio file;

compare the performance parameter received from the exercise station with the target parameter; and determine, based on the comparison, the performance metric of the exercise station.

5. The system of claim 4, wherein the input/output interface is communicably coupled to at least a second sensor associated with a second exercise station.

6. The system of claim 5, wherein the input/output interface is configured to receive performance data measured by the sensor and second sensor.

7. The system of claim 4, wherein the processor is further configured to:

identify an upper threshold parameter value and a lower threshold parameter value based at least in part on a data set including performance data measured at a plurality of exercise stations during the first portion of the exercise period, and calculate an expected parameter for the first portion of the exercise period based on the upper and lower threshold parameter values.

8. The system of claim 7, wherein the processor is further configured to:

calculate the target parameter for the sustained region of the exercise period based on the expected parameter.

9. A method of evaluating athletic performance, the method comprising:

providing a stationary bike having a non-transitory computer readable medium, a display unit, and a processor, wherein the processor;

executes an audio file stored in the non-transitory computer readable medium during an exercise period, the audio file being associated with at least one tempo;

measures a performance parameter associated with the stationary bike during the exercise period via a power meter sensor coupled to the stationary bike, the power meter configured to measure a performance parameter, and wherein the performance parameter is a power output;

calculates a target parameter based at least in part on the tempo of the audio file being played, wherein the target parameter is a target power output;

compares the target parameter to the measured performance parameter;

calculates a performance metric based at least in part on the comparison between the target parameter and the measured performance parameter; and communicates, at the end of the exercise period, a performance summary to the display unit, the performance summary including the performance metric.

10. The method of claim 9, further including:

recommending one or more audio files to a user of the stationary bike based at least in part on the performance metric.

11. The method of claim 9, wherein the performance summary further includes one or more of average revolutions-per-minute during the exercise period, distance ridden during the exercise period, and power generated during the exercise period.

12. The method of claim 9, further including measuring a plurality of performance parameters associated with a plurality of exercise stations during the exercise period.

13. The method of claim 12, wherein the calculating the target parameter is further based on the plurality of performance parameters measured at the plurality of exercise stations.

14. The method of claim 9, wherein the display unit is an electronic user device associated with a user of the exercise station.

* * * * *